United States Patent [19]

Kuever, deceased et al.

[11] 4,026,030

[45] May 31, 1977

[54] DRAFTING TEMPLATE

[76] Inventors: Paul H. Kuever, deceased, late of San Gabriel, Calif.; Hazel J. Kuever, surviving spouse, 8357 Woodlawn, San Gabriel, Calif. 91775

[22] Filed: Dec. 29, 1975

[21] Appl. No.: 644,909

[52] U.S. Cl. ..... 33/174 B; 33/103

[51] Int. Cl.[2] ..... B43L 7/08

[58] Field of Search ..... 33/174 B, 103, 108, 33/41 R, 174 G, 80; 35/38, 37, 36

[56] References Cited

UNITED STATES PATENTS

| | | | |
|---|---|---|---|
| 1,202,041 | 10/1916 | Fabrieius | 33/174 |
| 2,080,093 | 5/1937 | Rose | 33/174 B |
| 2,702,944 | 3/1955 | Lane et al. | 33/103 X |
| 2,784,497 | 3/1957 | Blondin | 33/174 B |
| 2,909,843 | 10/1959 | Bechtel | 33/80 X |

*Primary Examiner*—Richard E. Aegerter

[57] ABSTRACT

Adjustable drafting template characterized by relatively slideable members which may be positioned to form openings for drawing figures with two parallel sides of different widths and lengths having ends of various shapes; also, circles, chordal portions thereof, squares, portions thereof, and equilateral triangles.

12 Claims, 6 Drawing Figures

DRAFTING TEMPLATE

Background of the Invention

In the drafting art certain symbols and geometric figures of various sizes are repetitively required on a drawing. To avoid the time consuming procedure of drawing such figures, employing conventional instruments, such as triangles, compass, protractor, etc., it has long been the practice to provide templates with apertures therein, the edges of which are so shaped to form the desired figure by moving a pencil or pen around opening guide edges. Thus, templates having various size circles, ellipses, squares, hexagons, etc. are familiar. Due to the non-adjustability of such templates, however, they are limited somewhat in utility in that only one predetermined figure may be drawn with each aperture, or, if only a portion of the aperture is employed, then conventional drafting instruments must also be employed. Thus, if a slot with semi-circular ends is desired, one half of a circular aperture may be employed for each end and the figure completed by connecting such ends, employing a straight edge of any suitable form. This saves little time over the use of compass and T-square, or the like, and suffers the further disadvantage that skill is always required to join lines in exact alignment in contradistinction to a template wherein the line is continuous, the only points of alignment being at its starting and finishing point, which with a template, are usually overlapped.

Adjustable templates have also been proposed so that a predetermined size and shape of figure may be selected. The U.S. Patent to Lane No. 2,720,706 is exemplary of such type of template in which figures of several shapes having straight sides may be drawn. Until such time that an adjustable template is devised with which any shape and any size figure may be drawn, templates of this type will have their limitations in utility. Such limitations are not objectionable, however, if a specific template serves the major purposes of a draftman for a particular type of drawing. Moreover, in view of the relatively low cost of simple limited utility templates, as compared to a yet undevised and necessarily complicated adjustable all purpose template, the use of several limited utility templates will probably always be more economically practical.

SUMMARY OF THE INVENTION

The present invention relates to the class of adjustable drafting templates, just referred to, which has particular utility in electronic circuit drawings and others employing often repeated conventional figures or symbols of different sizes. The conventional shapes are squares, rectangles, circles and elongated slots with semi-circular ends, employed in many types of mechanical drawings. The electronic symbols include elongated figures with parallel sides and a flat base at one end and a pointed or semi-circular shape at the other end. Isosceles triangles and semi-circles may also be drawn as special forms of these shapes.

Several modifications are contemplated within the purview of the invention. In its most comprehensive form all of the shapes referred to may be drawn with one template. In its more limited form only a selected portion of such shapes may be drawn.

The generic form of the invention comprises a pair of rectilinearly slideable members which define slots of variable width and length having parallel sides and selected shaped ends.

In its more refined form, the members may be positively locked together and in all forms disclosed interchangeable parts may be employed to extend the field utility.

In accordance with the foregoing, the general object of the invention is to provide improvements in adjustable limited utility templates.

Another object is to optionally extend such utility by the use of interchangeable components.

Another object is to provide a template having a plurality of adjustable apertures therein for drawing a certain set of figures.

A further object is to provide a portion of the foregoing template for drawing a portion of the set of predetermined figures.

Still further objects, advantages, and salient features will become more apparent from the detailed description to follow, the appended claims, and the accompanying drawing, to now be briefly described.

DETAILED DESCRIPTION OF PREFERRED EMBODIMENTS

Figure 1:
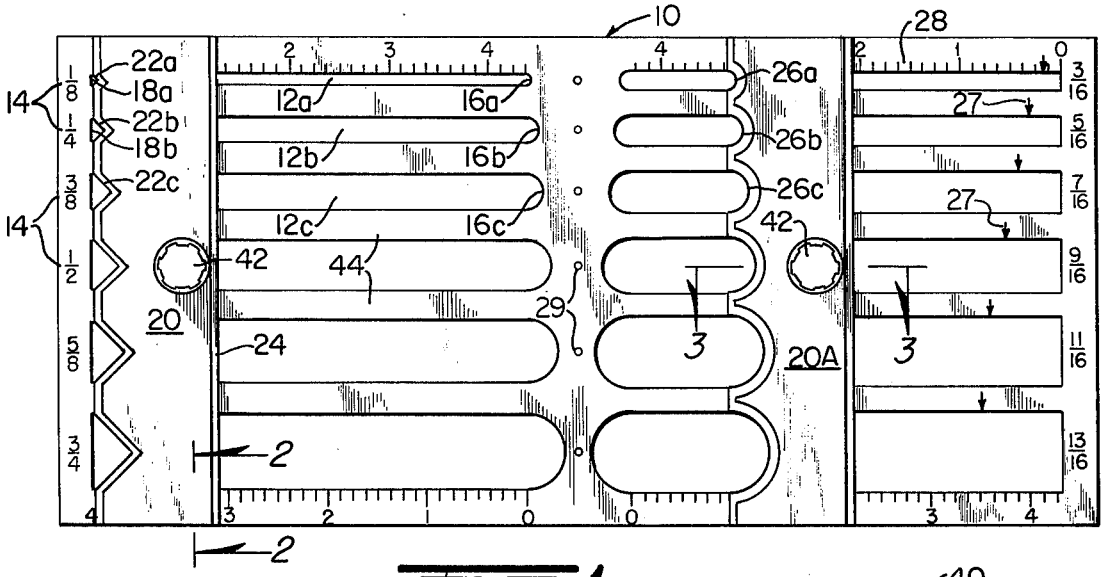
FIG. 1 is a top plan of one form of the invention.

Referring now to the drawing in detail, and first to FIG. 1, template 10 is a flat plate of plastic, celluloid or other material, preferably transparent, as commonly employed for drafting instruments such as triangles, French curves, fixed shapes, aperture templates, or the like, of the order of about ⅛ inch thickness.

The left half of the plate is provided with a plurality of parallel elongated apertures or slots **12*a*, 12*b*, 12*c*, etc., which increase in width, their widths being identified by suitable indicia 14. The right ends 16*a*, 16*b*, 16*c*, etc. of the slots are semi-circular and the left ends 18*a*, 18*b***, etc. are straight and perpendicular to the parallel edges. Preferably, the slots are of about the same length and their ends substantially aligned in the stacked arrangement illustrated to most effectively utilize the area of the plate.

A cursor or slideable member 20 extends across the slots and is suitably guided to move rectilinearly parallel thereto. The left edge of the cursor is provided with a plurality of isosceles triangle shaped cut-outs **22*a*, 22*b*, 22*c*, etc. disposed symetrically with respect to the slots. The right edge 24 of the cursor is straight and perpendicular to the edges of the slots. In the position shown, a plurality of isosceles triangles of different sizes may be drawn by moving an implement, such as a pencil or pen around the edges of the triangular openings. When the cursor 20** is moved to the right from that shown, the openings will be formed by parallel sides, a base or end perpendicular thereto and another end formed by two corresponding sides of an isosceles triangle, that is, as an arrow head with a flat base.

The slots at the right side of straight edge 24 are similar to those just described except that the ends are semicircular rather than triangular. These could thus be characterized as bullet-head symbols with flat bases. When cursor 20 is moved to the right such symbols or figures are shortened until they become semicircles.

Referring now to right cursor 20A, this differs from cursor 20 in that cut-outs 26*a*,26*b*,26*c*, etc., are semicircular, rather than triangular. The slots are the same as in the left half except that their ends are reversed. In the position shown, the openings at the left of cursor 20A are elongated slots with parallel sides and semicircular ends. When it is moved to its extreme left position the openings become circles. The openings at the right of the straight edge are rectangles in the position shown. When the cursor is moved to near its extreme right position (at indicia 27) they become squares. Further movement chops the squares into small rectangles.

Other suitable indicia 28 is preferably employed to identify the length of the openings. Also, small holes 29 are preferably provided for locating the center line of its associated slot.

CURSOR CONSTRUCTION

Figure 3:
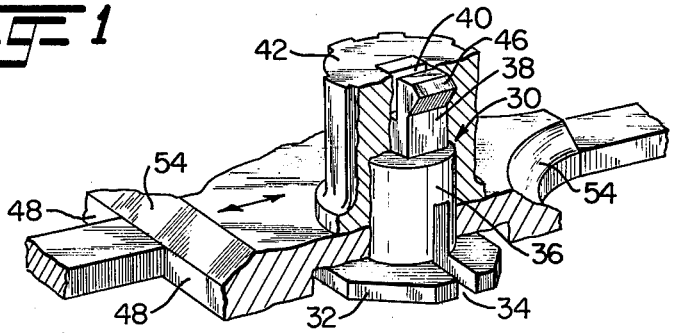
FIG. 3 is a broken-away isometric view taken substantially on line 3—3, FIG. 1.

Each of the cursors so far described is preferably provided with means for locking it in desired position and a description of one will serve for both. Referring to FIG. 3, a stud-like member 30 comprises a generally octagonal base 32 having a slot 34 therein, a round shank 36 and square terminal end 38 with a slot 40. Base 32 forms a resilient cam, by reason of its slot, and is proportioned to fit between a pair of adjacent legs 44 (FIG. 1) defining edges of a slot. When rotated, it cams against such legs forming a lock. Knob 42 fits the square shank and is resiliently retained thereon by end 38 which is provided with opposed detents 46.

Figure 2:
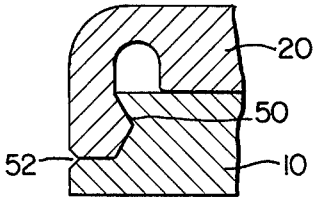
FIG. 2 is an enlarged section taken on line 2—2, FIG. 1.

The cursor is also provided with portions 48 which fit and slide between the various legs and maintain its direction of movement perpendicular to the axes of the slots. As best shown in FIG. 2, its outer edges are provided with resilient V-shaped guides 50 which slide in corresponding grooves in the opposite edges of plate 10. A bevel 52 is also provided for inserting a knife edge for removing the cursor when desired.

As best shown in FIG. 3, the straight and cut-out edges of the cursor are provided with bevels 54 so that the pencil guiding edges on the cursor lie in the same plane as the top surface of plate 10 to obviate slight errors in forming the end shapes which might otherwise occur.

Figure 4:
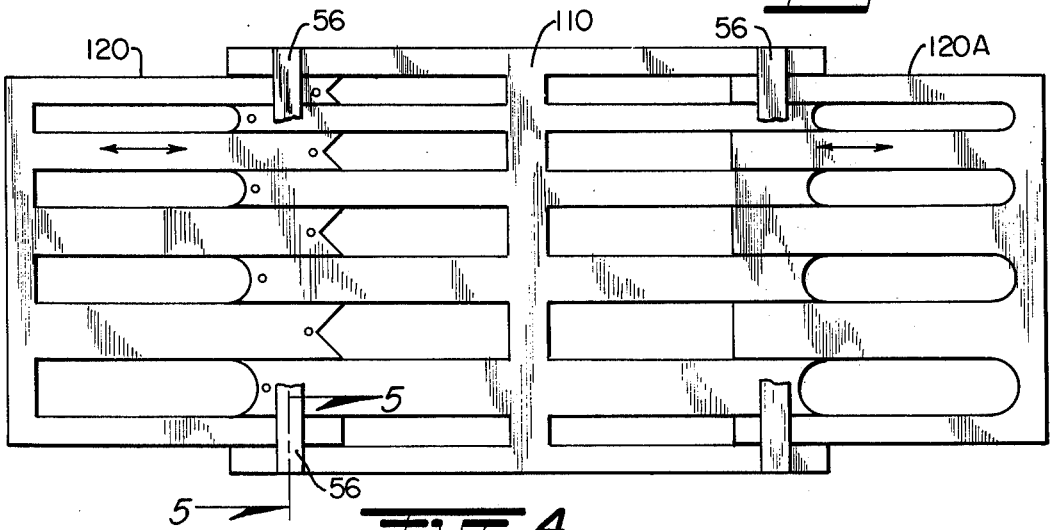
FIG. 4 is a top plan of an alternative form of the invention, portions being broken away.
Figure 5:
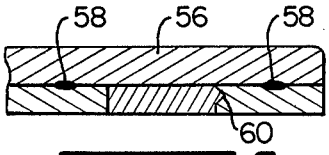
FIG. 5 is an enlarged section taken on line 5—5, FIG. 4.

Referring now to FIG. 4, this construction provides the same template shapes as FIG. 1 but in a somewhat less expensive form of construction. The central portion 110 may be considered analogous to plate 10 with its various slots and portions 120, 120A, may be considered analogous to cursors 20, 20A. In this construction, the three members lie in the same plane with the fingers on members 120, 120A slideably disposed in the slots of central member 110. Tie bars 56, extending across the width of member 110, may be provided to maintain the fingers of central member 110 in precise spaced parallel arrangement by welds 58 (FIG. 5). The outermost fingers are also preferably provided with v-shaped slides 60 to maintain the various portions in the same plane.

MODIFICATIONS

FIG. 1

The slots on the left side vary in width from one-eighth inch to three-fourths inch by increments of one-eighth inch. The slots on the right side vary in width from 3/16 to 13/16 inch, also by increments of one-eighth inch. Thus, slots are provided from one-eighth to 13/16 inch by increments of 1/16 inch. If it is desired to employ 1/16 inch increments with a limited shape of figures, then a cursor like 20A (not shown) may be substituted for cursor 20. As will be understood, it will differ from cursor 20 in that its semi-circular edges will point toward the like edges of cursor 20A. With this construction, circles from one-eighth to 13/16 inch diameter may be drawn in increments of 1/16 inch. As will be apparent, slots of like width with semi-circular ends may also be drawn. As will be further apparent, a cursor like cursor 20 (not shown) may be substituted for cursor 20A with its triangular edges pointing to the right. Similarly, arrow-headed slots may be drawn, differing in width by increments of 1/16 inch.

FIG. 4

Figure 6:
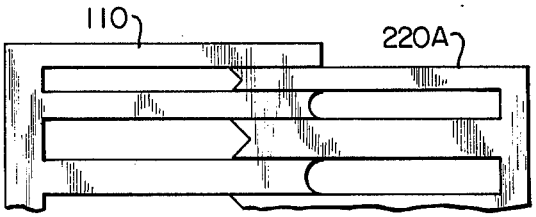
FIG. 6 is a top plan of a portion of FIG. 4, illustrating a modification thereof.

FIG. 6 illustrates the upper right portion of FIG. 4. With this construction only the right half of plate 110 is employed, together with the right slide member 120A shown in FIG. 4 and an auxiliary member 220A is provided of the shape shown in the left side of FIG. 4, these being interchangeable. With this construction all of the figures which may be drawn with the FIG. 4 construction may be drawn by the FIG. 6 construction. Otherwise stated, FIG. 4 duplicates the same width slots at each side of its center which are provided with sliders having different shaped ends. In FIG. 6 the duplication of the slots is eliminated and two interchangeable sliders 120A, 220A are provided having different shaped ends.

Further Modifications and Choices

If the user's needs are principally for circles, slots with semi-circular ends, squares and rectangles, then the right halves only, of FIGS. 1 or 4 may be provided. If a greater number of figure widths are desired then the entire structure of FIGS. 1 or 4 may be provided with slots of intermediate width and the appropriate cursor. If the user's principal needs are for arrow or bullet head figures then the left halves of FIGS. 1 or 4 may be provided, and similarly, if a greater number of figure widths are desired then the entire structure of FIGS. 1 or 4 may be provided with slots of intermediate width. If the user's needs are for both types of the groups of figures referred to, then the FIGS. 1 or 4 construction should be preferred if the user is to be limited to only one template.

In view of the exemplary combinations and variations, it will be apparent that further modifications are possible which are contemplated within the purview of the invention as set forth by the appended claims.

It is claimed:

1. A drafting template, comprising:

a. a flat relatively thin integral body of uniform thickness, b. said body having a plurality of spaced stacked elongated cut-outs therethrough, forming openings with surrounding edges, providing guides for moving a pencil or the like in contact therewith, for forming a desired line on a drawing upon which a bottom face of the body is adapted to lie in contact therewith, c. each opening including parallel edges of differing spacings therebetween, d. a first straight edge joining the parallel edges of each opening at one end thereof and perpendicular thereto, e. a second semi-circular edge joining the parallel edges of each opening at the other end thereof.

f. a slideable member moveable across the top face of the body in a direction parallel to said parallel edges and between ends of the openings, g. said slideable member having a third straight edge at one side thereof crossing all of the openings perpendicular to their parallel edges, h. said slideable member also having a plurality of cut-outs at an opposite side thereof forming fourth edges, each forming a symmetrical shape within a 180° arc, the ends of which arc join the parallel edges, forming ends of the opening with which each is associated.

2. A template in accordance with claim 1 wherein said fourth edges are two sides of an isoceles triangle and cooperate with the straight edges at one end of the openings to thereby form (1) isoceles triangles or (2) figures with parallel sides, a flat base at one end and an arrow head shape at the other end.

3. A template in accordance with claim 1 wherein said fourth edges are semi-circular and cooperate with the semi-circular edges at said other end of the openings to form (1) circular openings or (2) elongated figures with parallel sides and semi-circular ends.

4. A template in accordance with claim 1 having two sets of openings of the shape defined and a slideable member for each set, said fourth edges on one slideable member being semi-circular and adapted to cooperate with the semi-circular edges at one end of the openings of one set to form circular openings or elongated figures with parallel sides and semi-circular ends, said fourth edges on the other slideable member being two sides of an isoceles triangle which cooperate with the straight edges at one end of the openings of the set to thereby form isoceles triangles or figures with parallel sides, a flat base at one end and an arrowhead shape at the other end.

5. A template in accordance with claim 1 wherein said body is rectangular and provided with guides in the edges thereof which are parallel with the slots, the slideable member having ends adapted to slideably engage the guides, and means for releasably locking the slideable member to the body at a desired slideable position therealong.

6. A template in accordance with claim 5 wherein the locking means comprises a rotatable cam engageable with the body at a position thereon between adjacent openings.

7. A template in accordance with claim 6 including manual means, such as a knob, for rotating the cam.

8. A template in accordance with claim 1 including apertures extending through the body in positions in alignment with the centerline of each opening for aligning the openings with a reference line on a drawing.

9. A drafting template in accordance with claim 1 including scales on the body for indicating the position of edges of the slideable member relative thereto and a length of an opening.

10. A drafting template in accordance with claim 1 including indicia on the body for indicating the position of the slideable member for drawing squares.

11. A drafting template in accordance with claim 1 wherein said slideable member is provided with bevels to dispose said third edge and said fourth edges in the plane of the top face of the body.

12. A drafting template comprising;

a. a flat relatively thin integral sheet of material of uniform thickness forming a body, b. said body having sets of spaced stacked elongated cut-outs therethrough, forming openings with surrounding edges providing guides for moving a pencil or the like in contact therewith, for forming a desired line on a drawing upon which a bottom face of the body is adapted to lie in contact therewith, c. each opening in a set including parallel edges of different spacings therebetween, d. a first straight edge joining the parallel edges of each opening at one end thereof and perpendicular thereto, e. a second semi-circular edge joining the parallel edges of each opening at the other end thereof, f. a first slideable member movable across the top face of one set of openings in a direction parallel to said parallel edges and between ends of the openings of the set, g. said first slideable member having a third straight edge at one side thereof crossing the openings of the set perpendicular to their parallel edges, h. said first slideable member also having a plurality of semicircular fourth edges at another side thereof joining the parallel edges.

i. a second slideable member moveable across the top face of another set of openings in a direction parallel to said parallel edges and between ends of the openings of the set, and having a like third straight edge crossing the openings of said another set perpendicular to their parallel edges, j. said second slideable member having a plurality of edges which are sides of an isoceles triangle and cooperate with straight edges at one end of the openings, k. the construction and arrangement being such that the first slideable member may form, at one side thereof, squares or rectangles of various sizes and, at its other side, circles or elongated figures with parallel sides and semi-circular ends, i. the construction and arrangement also being such that the second slideable member may form, at one side thereof, isoceles triangles or figures with parallel sides, a flat base at one end, and an arrowhead shape at the other end, and form, at the other side thereof, semi-circles or elongated figures with parallel sides, a flat base at one end and a semi-circular shape at the other end.

* * * * *